US009734807B2

(12) United States Patent
Martinelli

(10) Patent No.: US 9,734,807 B2
(45) Date of Patent: Aug. 15, 2017

(54) MUSICAL INSTRUMENT MULTIPLE MEMBRANE PERCUSSION AND SHAKING

(71) Applicants: Carlo Martinelli, Pistoia (IT); Noemi Franceschi, Pistoia (IT)

(72) Inventor: Carlo Martinelli, Pistoia (IT)

( * ) Notice: Subject to any disclaimer, the term of this patent is extended or adjusted under 35 U.S.C. 154(b) by 0 days.

(21) Appl. No.: 15/233,974

(22) Filed: Aug. 11, 2016

(65) Prior Publication Data

US 2017/0047052 A1 Feb. 16, 2017

(51) Int. Cl.
*G10D 13/02* (2006.01)

(52) U.S. Cl.
CPC ..... *G10D 13/02* (2013.01); *G10D 13/027* (2013.01)

(58) Field of Classification Search
CPC ..... G10D 13/02; G10D 13/08; G10D 13/021; G10D 13/023; G10D 13/028; G10D 13/00; G10D 13/026; G10K 3/00; G10K 1/10; G10G 1/00
USPC ..... 84/411 R, 402–410
See application file for complete search history.

(56) References Cited

U.S. PATENT DOCUMENTS 7,214,867 B1 * 5/2007 Gatzen ..... G10D 13/027 84/411 R
7,910,816 B2 * 3/2011 Glowacki ..... G10D 13/06 446/419

* cited by examiner

*Primary Examiner* — Kimberly Lockett
(74) *Attorney, Agent, or Firm* — Mark M. Friedman

(57) ABSTRACT

Musical instrument of the type called "ocean drum" provided with three or more vibratile membranes, in the interspaces of which some balls of different materials and diameters, phosphorescent as well, are inserted. By tilting said drum, provided with two or more planes bearing some balls, the latter roll on the internal surface of the membranes produces sounds that evoke sea waves. Said "ocean drum" has a plurality of rings with a common central axis, aligned in a fixed way to enable the insertion of three or more vibratile membranes between them. Said rings are made of laminated plywood, solid wood or plastic material. They are glued, without discontinuity, to the circular membranes made of animal leather, or of polymer films provided with holes on a median diameter of the rings for more resistant gluing.

6 Claims, 4 Drawing Sheets

Figure 1:
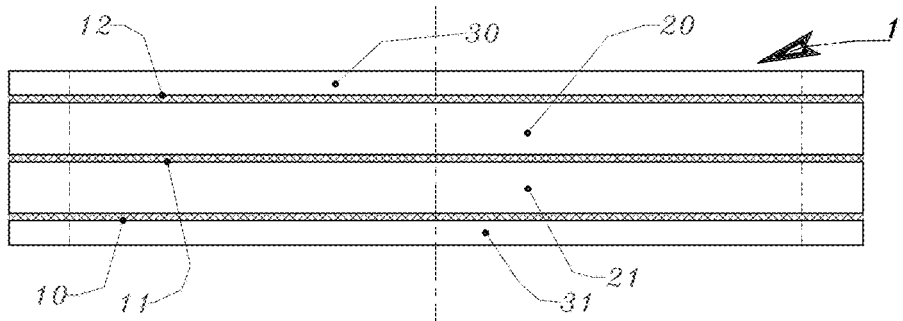

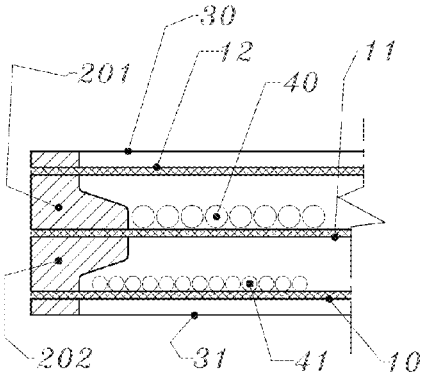
Fig. 4
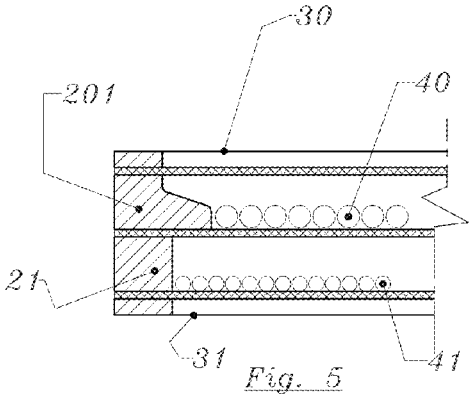
Fig. 5
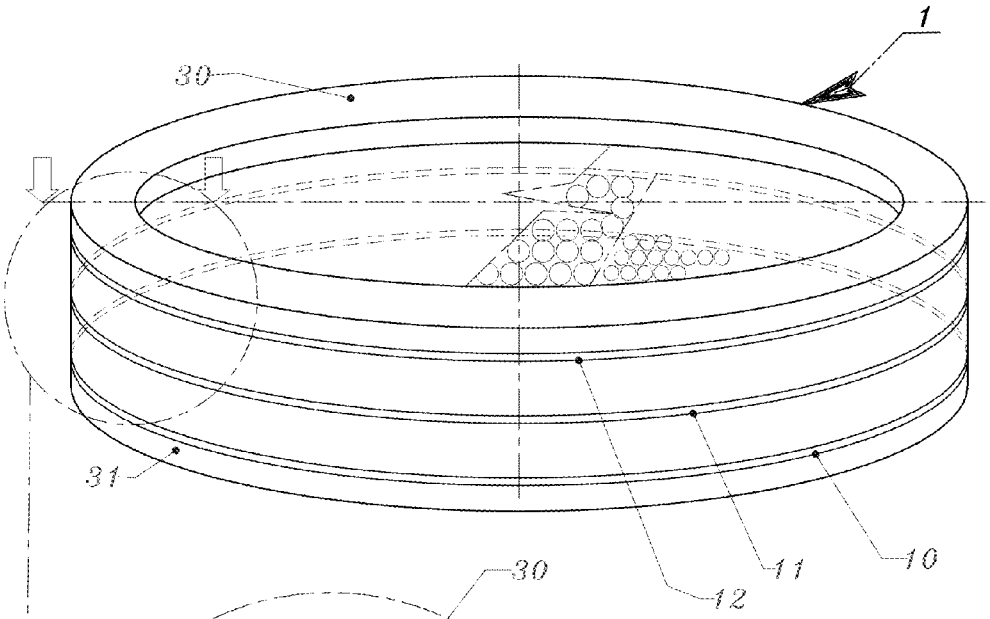
Fig. 6
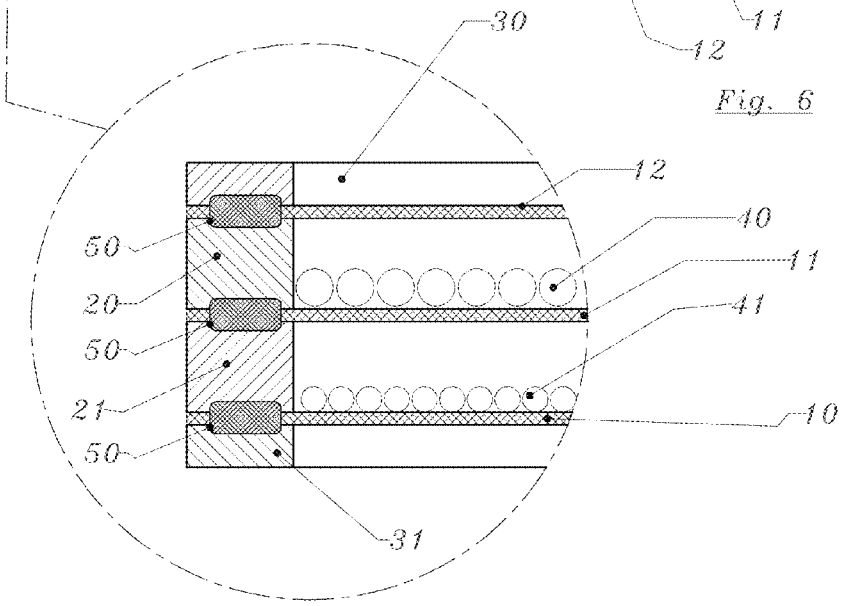

MUSICAL INSTRUMENT MULTIPLE MEMBRANE PERCUSSION AND SHAKING

CROSS-REFERENCE TO RELATED APPLICATION

This application claims priority to Italian Patent Application number 202015000044490. The earliest priority date claimed is Aug. 13, 2015.

FEDERALLY SPONSORED RESEARCH

None

SEQUENCE LISTING OR PROGRAM

None

DESCRIPTION

The present Utility Model relates to a percussion and shaking musical instrument, which in this sector's jargon is called "ocean drum".

The musical instrument called and universally recognized as "ocean drum" is formed by a cylindrical or annular body of variable generatrix or height and absolutely similar to that of a normal drum, provided, on the base of the cylinder, with a pair of vibratile membranes well fixed on all the circumferences, upper and lower, so as to form a cylindrical container tightly sealed on all the surfaces.

The instrument of the "ocean drum" type is a drum normally provided with an annular hollow body of different thickness, depending on the use. On two circular bases, on both sides, two vibratile membranes are tensioned while, as already stated, inside the instrument there are small balls. If one tilts the plane of the membranes by rotating and moving, the balls produce a sound similar or identical to that of ocean waves. Said balls can become phosphorescent to enhance the instrument's visual qualities.

Percussionists are major figures in the music world. Hence, there is great interest by musical instrument manufacturers in drums of this type. Said musicians are always searching for new sounds and fancy effects, or effects resembling natural sounds such as wind, rain, thunder and the sea. Therefore, these types of instruments are also used fields other than just the musical field. For example, these instruments are used in such activities as relaxation, meditation, music therapy and musical activities for children. In the latter activities, it should be noted that the motion of the balls which, by rolling, create fascinating patterns that promote relaxation and concentration.

Furthermore, there are also instruments, that are apparently similar but which, on the other hand, are included in a category where the sliding of the balls is not used as in the present use, but the balls are used for sound due to the rotation on spherical or cylindrical surfaces even within hollowed guiding paths, and in any case referred to as instruments like "shakers" and not "drums".

SUMMARY

The present instrument provides some improvements to said "ocean drum", provided with three vibratile membranes, instead of the two normally present in the drums of this type, and some balls of different materials and diameters, phosphorescent as well, are inserted in the cylindrical compartments or interspaces created by the three membranes.

Therefore, by tilting the drum, the balls contained in the two compartments roll and run along the innermost surfaces of the membranes producing different sounds, which, however, always evoke the sound of the waves of the sea.

The body of the instrument consists of a series of rings or cylindrical surfaces connected to each other, with a common central axis, in a permanent way with the three vibratile membranes placed between the various rings, above, below and between the (cylindrical or annular) bodies constituting said stack.

Basically, they are two adjacent drums with identical axes and radial dimension wherein the rings and/or the cylinders which make them up are made of laminated plywood, solid wood or materials currently used in the production of such instruments; said rings or cylindrical surfaces never have to be jointed but rather have to be undivided in a circumferential direction and absolutely made up of one single, never discontinuous, piece.

The possibility of adding a third ring with a membrane in order to create a third plane or level, also containing balls, comes under the concept of improvement of the present Utility Model.

The vibratile membranes are made of animal leather or of synthetic material, in general, in very thin polymer films, with thickness ranging from 0.07 to 0.35 mm. A particularly suitable, highly oriented crystalline polymer film is the biaxially oriented sheet of condensation polymer of ethylene glycol and terephthalic acid; particularly known as Mylar by the international company EI Dupont de Nemours & Co. That is to say, synthetic films very stable to climate variations also providing flexibility, long duration and good tensile strength.

Normally, in order to be mounted on the body of the drum and well tensioned, the polymer film is soaked in a liquid solvent dip until the film swells up and becomes sufficiently soft to be able to be draped on the drum shell, in percentage terms the swelling is about 5%.

Therefore, once the solvent has evaporated, the film returns to the original condition firmly fixed to the body of the instrument, and it is sufficiently tensioned in order to generate sound if subjected to percussion.

The edge folded on the external strip is glued and then, once it has dried, remains adherent to the outside of the cylindrical edge.

In the present case, on the other hand, the various rings are stacked inserting between them some discs of vibratile membranes of the mentioned materials without external edges, that is to say, discs having an available diameter amounting to 94% of the external diameter of the rings making up the drum. Said discs are glued to the rings performing the same treatment with the solvent; moreover, in order to improve the adhesion between the rings and the membranes, a series of holes, of the punching type, was made on the vibratile membranes along an intermediate circumference in the radial thickness of the rings where a "nail" of glue passing between two adjacent rings and the membrane will be placed.

In order to further improve adhesion, in correspondence with the holes of the membranes, some blind holes are made on the retaining rings in such a way as to increase the adhesion of the hardened glue between the two rings adjacent to the membrane.

DRAWINGS

FIG. 1 shows an "ocean drum" 1 provided with three membranes 10, 11 and 12 contained between four rings with cylindrical development and rectangular or square section, two external rings 30 and 31 and two internal rings 20 and 21.

Figure 2:
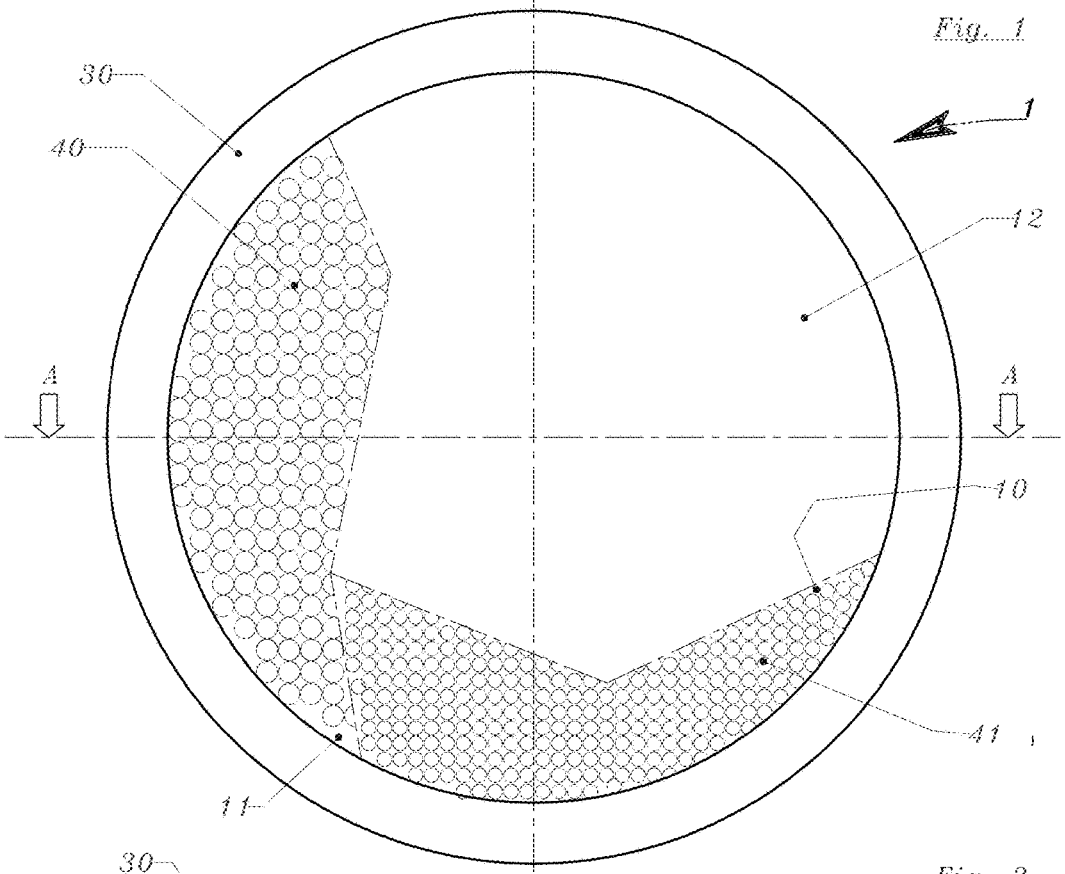

FIG. 2 is a view from above of the present drum with three membranes 12, 11 and 10

Figure 3:
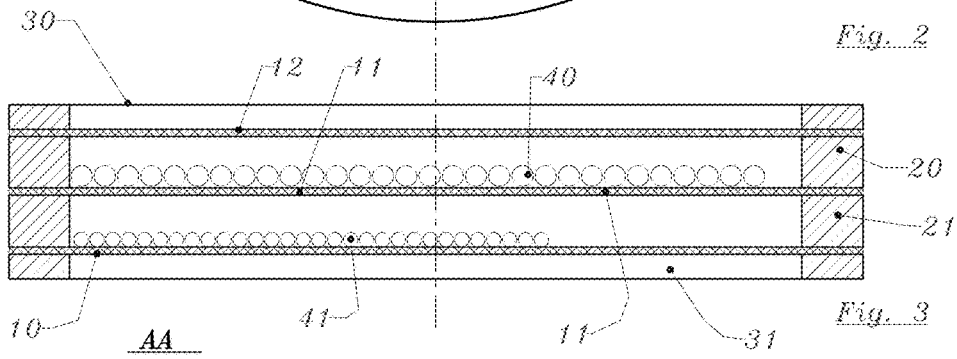

FIG. 3 whos the section AA of the view of FIG. 2

FIG. 4 and FIG. 5 propose different sections of the retaining rings 201 and 202 of the central membrane 11

FIG. 6, with the perspective view and the lens which highlights its section

Figure 7:
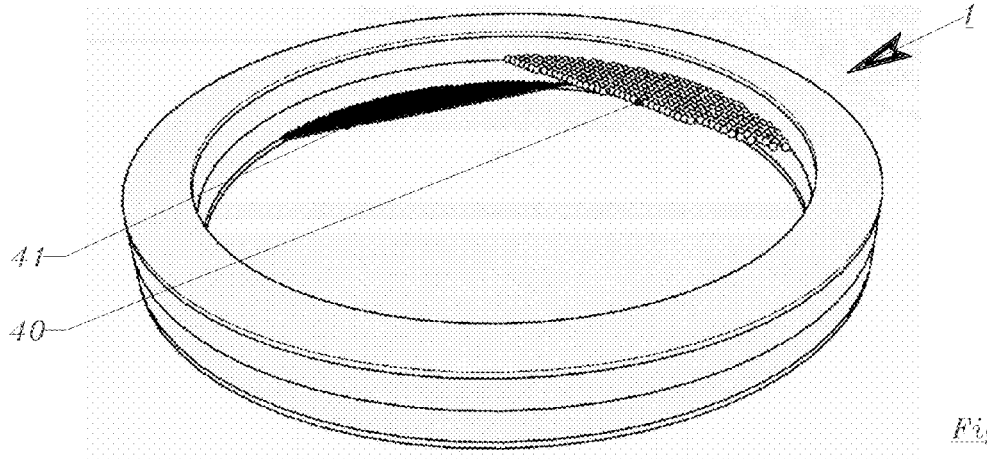
Figure 8:
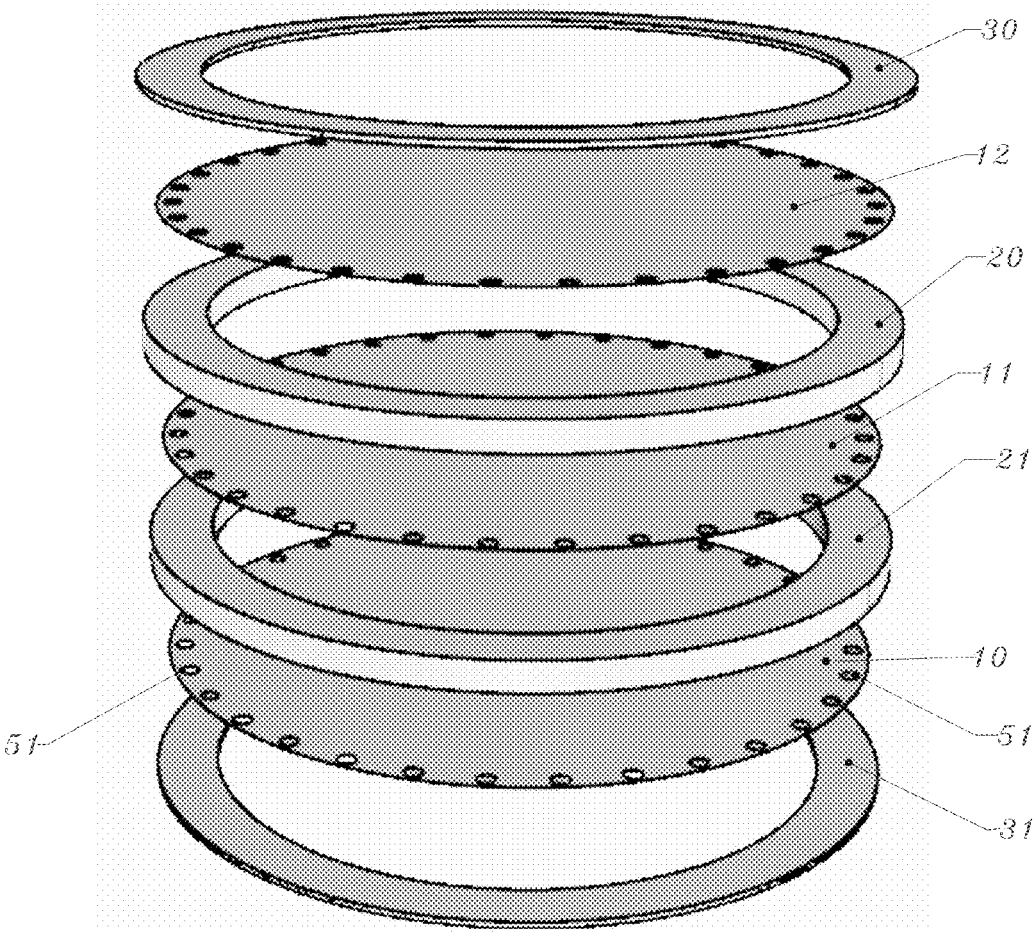
Figure 9:
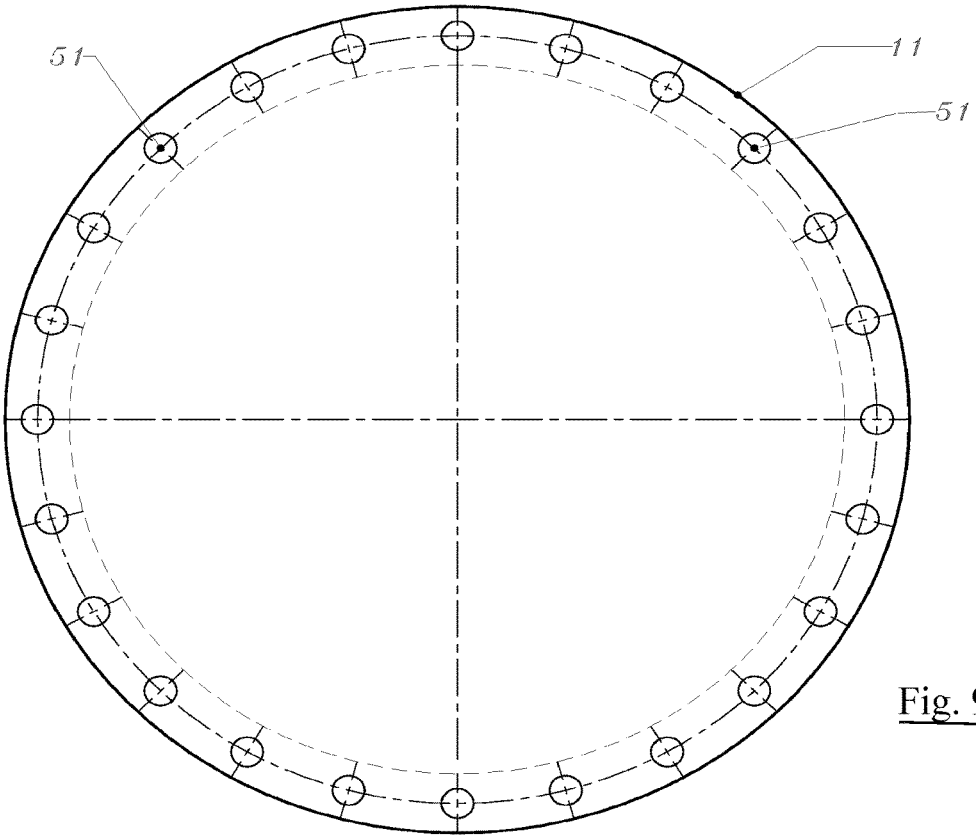
Figure 10:
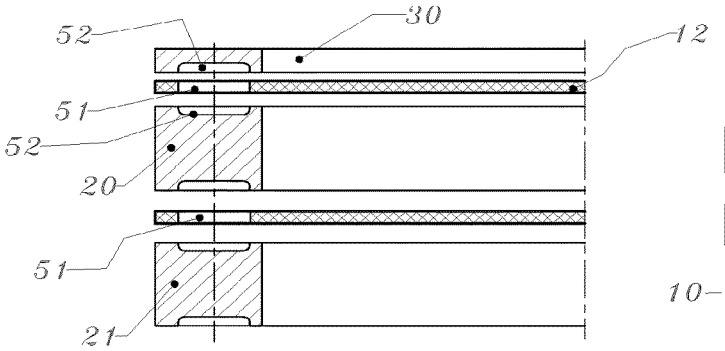
Figure 11:
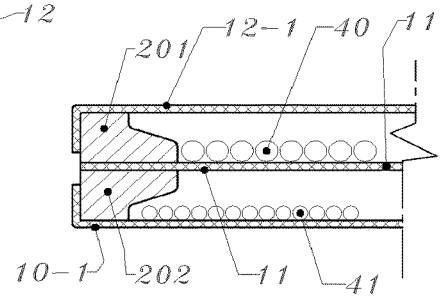
Figure 11:
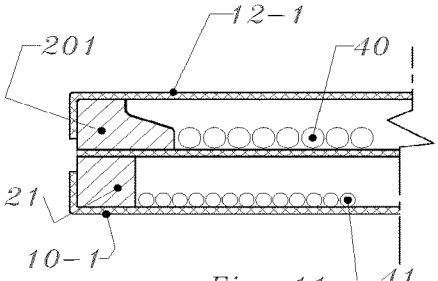

FIG. 7 and FIG. 8 show images of the various exploded rings and membranes to be assembled FIG. 10 shows the sheet 11 having a series of holes 51 arranged on a median diameter of the thickness of the external rings FIG. 11 shows the drape of the membrane.

REFERENCE NUMERALS

1—Instrument of the percussion type with three or more membranes placed alternately to retaining rings, said instrument being conventionally called "ocean drum", wherein on two of the three planes formed by the vibratile membranes some balls with different characteristics have been inserted on each plane, that is to say, different diameter, specific weight and material, which produce different musical nuances modifiable by the performer and in any case, in general, always able to evoke the sound of the waves of the sea and different lights if phosphorescent.

10—Lower membrane made of animal leather or of crystalline polymer film known by the trade name of Mylar produced by the company EI Dupont, it is a disc having the same diameter as the various stacked cylindrical rings, between which it will be inserted, having a thickness between 0.07 and 0.35 mm; moreover, on a diameter, indicatively corresponding to the centre lines of the radial width of the rings, it can have a series of holes so as to enable gluing, by means of nails of glue, between the upper and the lower ring with respect to the present membrane.

11 and 12—Membranes completely similar to 10, placed above the membrane 10, they can be in a number greater than two in addition to 10, they, too, having thicknesses between 0.07 and 0.35 mm.

20 and 21—Rings or internal cylinders of the drum made without joints of laminated plywood or solid wood or also of special synthetic plastic materials, although of less value, one can also add one or more rings of the 20 or 21 type to increase the number of planes containing the balls, moreover, as better specified hereinafter, on these rings as well as on 30 and 31 and on the membranes 10, 11 and 12 some holes can be made, blind holes in this case, to contain in alignment with respect to each other some cylinders of adhesive to peripherally glue the various membranes, different, in this case, from the normal methods of tensioning and locking of the vibratile membranes of drums currently available on the market.

30 and 31—External rings of completion-retaining of the stack, they fix the two external membranes to the internal rings with glue or holes as described in relation to 20 and 21.

40 and 41—Examples of employed balls of different materials and different diameters, it is evident that they can be varied depending on the desired sound effects, in general they can be of plastic, ceramics, aluminium and resin with diameters from 3 to 6 mm and balls of steel, chrome-plated or copper-plated lead and aluminium with a diameter between 1 and 3 mm, it is also possible to insert inside the instrument balls of phosphorescent plastic, which, if the instrument is used in the dark, enhance its visual quality.

50—Indication of the glue applied between the rings and the membranes, in this case they also form some nailings in correspondence of the holes of the membranes and small blind holes (52) on the rings.

51—Holes in the peripheral area of the membranes to increase adhesion in the gluing of the various membranes with the rings adjacent to them.

52—Indicating a blind hole or shallow recess on the rings in correspondence of the holes 51 made on the membranes.

10-1 and 12-1—Membranes applied to the upper and lower rings with the traditional method of the normal drums, that is to say, folding back the edge on the rings, said edge is either glued or fixed with normal small metal cramps, this process being carried out after soaking the membrane with a liquid solvent which makes it soft to be tensioned and draped on said edge of 20 or 21 or analogous rings.

201 and 202—Alternative shapes of the frames 20 and 21, they do not have rectangular or square sections but a shaped section to increase the gluing surface of the membranes but also producing musical variations.

DETAILED DESCRIPTION

By examining the enclosed figures, it is very simple to understand the type of construction of this percussion and shaking instrument capable of containing free balls of different sizes and materials, including phosphorescent, between the three or more membranes. Said balls, by sliding, produce sounds similar to the swooshing sound of the sea.

FIG. 1 shows an "ocean drum" 1 provided with three membranes 10, 11 and 12 contained between four rings with cylindrical development and rectangular or square section, two external rings 30 and 31 and two internal rings 20 and 21. Said membranes are glued and, once they have been fixed firmly to the support, tensioned by heating them to a specific temperature on the basis of the desired elongation. In order to obtain heat shrinking, said membranes are linked to the degree of tensioning of the leather desired for the different musical uses.

In FIG. 2, which is a view from above of the present drum with three membranes 12, 11 and 10, one can see the balls of different sizes resting on the membranes 10 and 11, and in FIG. 3, showing the section AA of the view of FIG. 2, the membranes are highlighted: 10 included and glued between the rings 31 and 21 and bearing the balls 41, 11 tightened and glued between 20 and 21 and bearing the balls 40 and, finally, 12, the upper membrane, which, too, is included and glued between the rings 30 and 20.

Indicatively, the vibratile membranes like those indicated in the just mentioned figures have an available diameter amounting to 94% of the diameter of the rings made, as already said, of continuous laminated plywood or of solid wood but also with good synthetic materials, all of which must not feature neither discontinuity nor joints.

The following FIG. 4 and FIG. 5 propose different sections of the retaining rings 201 and 202 of the central membrane 11, sections which can also alternate with the normal rectangular or square sections in order to also have greater surfaces of the membranes with reduced base, although to the detriment of the greater gluing area with 201 and 202.

FIG. 6, with the perspective view and the lens which highlights its section, provides a full view of the preferred embodiment for the realization of this double "ocean drum" with nails or buttons of glue between the rings and membranes, with holes towards the external edge thereof according to the present Utility Model.

The membranes 10, 11 and 12 of Mylar with a thickness between 0.07 and 0.35 mm or of animal leather, according to tradition, are arranged between the various rings in a number of three but also a fourth or even a fifth membrane with as many rings of the 20 and 21 type, can be added for uses desired by the users of these "ocean drums". FIG. 6 also shows, in the lens, the section with the various rings between which the membranes with some gluing nails or buttons 50 are inserted, able to contain the membrane through suitable holes 51, but also to create a robust connection between the rings by means of blind holes which are better specified in FIG. 10 hereinafter.

Continuing with the examination of FIG. 7 and FIG. 8, in addition to the assembly perspective, the image of the various exploded rings and membranes to be assembled is also shown, from said FIG. 8 one can see the holes 51 on the membranes even if in this solution the corresponding blind holes on the rings for simpler and elementary gluing have not been made, although in the presence of 51.

To complete the examination of the enclosed tables, FIG. 10 shows the sheet 11 having a series of holes 51 arranged on a median diameter of the thickness of the external rings; as one can observe in the partial section, on the lower part said holes 51 correspond to as many shallow recesses or blind holes 52, made on said rings.

At the moment in which the glue is spread on said median diameter and specifically on the holes 51, some gluing buttons or nails 50 will be made connecting rings and membranes between 52-51-52, to ensure duration and stability of the couplings and of the tensioning of the sheet between the rings.

Finally, the logical possibility of coupling different frames like 20, 21, 201 and 202 to each other with membranes, be they both upper and lower, such as 12-1 or 10-1 tensioned and draped externally on the shell. Here, too, as in the production and construction of normal drums, natural or synthetic sheets of Mylar are used with elongations at the origin of about 5%.

Finally, we would like to point out that the technique here indicated in FIG. 10 and in the previous figures, with the holes 50, 51 and 52, provides an improvement of gluing, which solves the lack of gluing along the shell, as in FIG. 11 of the drape of the membrane.

The following are claimed:

1. A percussion and shaking musical instrument comprising:

three or more circular vibratile membranes a plurality of rings making up a shell of a drum and having a common central axis and aligned fixed to enable insertion of the three or more circular vibratile membranes between said plurality of rings, said alignment being without discontinuity, a plurality of balls configured in interspaces between the three or more circular vibratile membranes, wherein said circular vibratile membranes are cut in accordance with an external circumference of the rings and with a series of holes having diameters substantially equal to a median diameter of a thickness of the rings, and wherein said circular vibratile membranes have a peripheral edge provided with a series of through-holes;

said rings also having a series of blind holes in correspondence of the series of through holes of the circular vibratile membranes to contain adhesive forming glue nails or pins.

2. The percussion and shaking musical instrument of claim 1, wherein the rings are provided with flat contact surfaces glued to the vibratile circular membranes provided with the through-holes and having a greater diameter with respect to the vibratile circular membranes.

3. The percussion and shaking musical instrument of claim 1, wherein at least one of the circular vibratile membranes is folded or draped on a shell of the instrument and glued to the instrument.

4. The percussion and shaking musical instrument of claim 1, wherein the plurality of balls are selected from the group consisting of:

(a) various diameters, (b) various materials of different natures, and (c) phosphorescent.

5. The percussion and shaking musical instrument of claim 1, wherein the circular vibratile membranes consist of a material selected from the group consisting of:

(a) animal leather, (b) synthetic material, (c) thin polymer film, (d) highly oriented crystalline polymer film, and (e) biaxially oriented sheet of a condensation polymer of ethylene glycol and terephthalic acid.

6. The percussion and shaking musical instrument of claim 1, wherein said plurality of rings consists of a material selected from the group consisting of:

(a) laminated plywood, (b) solid wood, and (c) plastic.

* * * * *